US010669667B2

(12) United States Patent
Prajescu et al.

(10) Patent No.: US 10,669,667 B2
(45) Date of Patent: Jun. 2, 2020

(54) SYSTEM AND METHOD FOR DETECTING MOISTURE CONTENT IN A DRYER APPLIANCE

(71) Applicant: Haier US Appliance Solutions, Inc., Wilmington, DE (US)

(72) Inventors: Ionelia Silvia Prajescu, Louisville, KY (US); Giancarlo Hazael Paez Gonzalez, Queretaro (MX); Julio Alberto Anaya Lopez, Queretaro (MX); Carlos Humberto Reyes Andres, Querétaro (MX)

(73) Assignee: Haier US Appliance Solutions, Inc., Wilmington, DE (US)

( * ) Notice: Subject to any disclaimer, the term of this patent is extended or adjusted under 35 U.S.C. 154(b) by 84 days.

(21) Appl. No.: 15/968,791

(22) Filed: May 2, 2018

(65) Prior Publication Data

US 2019/0338458 A1 Nov. 7, 2019

(51) Int. Cl.

| | |
|---|---|
| ***F26B 19/00*** | (2006.01) |
| ***D06F 58/28*** | (2006.01) |
| ***D06F 58/02*** | (2006.01) |

(52) U.S. Cl.

CPC ..... *D06F 58/28* (2013.01); *D06F 58/02* (2013.01); *D06F 2058/2819* (2013.01); *D06F 2058/2829* (2013.01); *D06F 2058/2854* (2013.01); *D06F 2058/2861* (2013.01)

(58) Field of Classification Search

CPC .. D06F 58/28; D06F 58/02; D06F 2058/2819; D06F 2058/2829; D06F 2058/2854; D06F 2058/2861

USPC ..... 34/528, 550

See application file for complete search history.

(56) References Cited

U.S. PATENT DOCUMENTS

| | | | | |
|---|---|---|---|---|
| 5,347,727 | A | 9/1994 | Kim | |
| 6,122,840 | A | 9/2000 | Chbat et al. | |
| 8,701,309 | B2 | 4/2014 | Park et al. | |
| 8,974,546 | B2 * | 3/2015 | Ghosh | D06F 35/00 252/8.61 |
| 9,322,127 | B2 | 4/2016 | Ashrafzadeh et al. | |
| 2006/0130817 | A1 * | 6/2006 | Gonze | F02D 41/004 123/520 |
| 2007/0163056 | A1 * | 7/2007 | Lee | D06F 25/00 8/149.2 |
| 2007/0186438 | A1 * | 8/2007 | Woerdehoff | D06F 58/28 34/486 |
| 2009/0313848 | A1 | 12/2009 | Moschutz et al. | |

(Continued)

*Primary Examiner* — John P McCormack

(74) *Attorney, Agent, or Firm* — Dority Manning, P.A.

(57) ABSTRACT

A dryer appliance and a method of detecting a moisture content of clothes in the dryer appliance are provided. The dryer appliance includes a top bearing positioned proximate a front of a rotating drum and temperature and humidity sensors positioned behind the top bearing for measuring a chamber temperature and humidity as well as a temperature sensor for measuring the exhaust temperature. A controller implements a method of detecting the moisture content of clothes within the drum by obtaining the chamber and exhaust temperatures and the chamber humidity, estimating the moisture content using these values, and adjusting at least one operating parameter of the dryer appliance in response to the estimated moisture content of the clothes.

20 Claims, 6 Drawing Sheets

(56) References Cited

U.S. PATENT DOCUMENTS

| | | | | |
|---|---|---|---|---|
| 2010/0305859 | A1* | 12/2010 | Fogarty | G01W 1/06 702/2 |
| 2012/0124859 | A1* | 5/2012 | May | D06F 58/28 34/572 |
| 2012/0160011 | A1* | 6/2012 | Whittaker | E21B 43/24 73/30.03 |
| 2015/0168064 | A1* | 6/2015 | Ingrosso | D06F 58/20 34/487 |
| 2016/0076193 | A1* | 3/2016 | Santillan Galvan | D06F 58/28 700/275 |
| 2019/0145817 | A1* | 5/2019 | Shim | G01H 11/06 |

* cited by examiner

SYSTEM AND METHOD FOR DETECTING MOISTURE CONTENT IN A DRYER APPLIANCE

FIELD OF THE INVENTION

The present subject matter relates generally to dryer appliances, and more particularly to systems and methods for detecting the moisture content of clothes within dryer appliances.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a heater assembly that passes heated air through the chamber in order to dry moisture-laden articles positioned therein. Typically, an air handler or blower is used to urge the flow of heated air from chamber, through a trap duct, and to the exhaust duct where it is exhausted from the dryer appliance.

Conventional dryer appliances use two stainless steel sensor rods positioned within the chamber to detect the moisture content of a laundry load. More specifically, the two sensor rods are spaced apart and positioned such that the rotation of the drum causes clothes to contact both rods. The dryer appliance measures the resistance between the sensor rods or the conduction of electric current through the clothes contacting the rods to determine their moisture content.

However, current sensor rod systems do not provide precise moisture content detection, particularly at low moisture content levels. Typically, this inaccuracy is compensated for by increasing cycle time to achieve the desired final moisture content of the clothes. In addition, the signals generated by current sensor rod systems are very dependent of the type of load being dried, e.g., with delicate loads generating noisy signals and cotton loads generating smoother signals. As a result, heavy filtering processes are required, making the signal less reliable. The size of the load being dried also affects the output of current sensor rod systems.

Accordingly, an improved system and method for detecting the moisture content of a load of clothes is desirable. More specifically, a dryer appliance having more improved and reliable means for detecting the moisture content of clothes and adjusting the dryer appliance accordingly would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a method of detecting a moisture content of clothes in a dryer appliance is provided. The dryer appliance includes a drum defining a chamber, a chamber temperature sensor being positioned proximate a top of the drum, an exhaust temperature sensor, and a humidity sensor being positioned proximate a top of the drum. The method includes measuring a chamber temperature using the chamber temperature sensor and an exhaust temperature using the exhaust temperature sensor. The method further includes measuring a chamber humidity using the humidity sensor and estimating the moisture content of the clothes in the dryer appliance using the chamber temperature, the exhaust temperature sensor, and the chamber humidity. The method includes adjusting at least one operating parameter of the dryer appliance in response to the estimated moisture content of the clothes.

In another aspect of the present disclosure, a dryer appliance is provided including a cabinet, a drum rotatably mounted within the cabinet, the drum defining a chamber for receipt of clothes for drying, and a top bearing positioned proximate a front of the drum. A chamber temperature sensor is positioned within the top bearing for measuring a chamber temperature, an exhaust temperature sensor is positioned within a trap duct for measuring an exhaust temperature, and a humidity sensor is positioned within the top bearing for measuring a chamber humidity. A controller is operably coupled to the temperature sensor and the humidity sensor. The controller is configured for obtaining the chamber temperature using the chamber temperature sensor, obtaining the exhaust temperature using the exhaust temperature sensor and obtaining the chamber humidity using the humidity sensor. The controller is further configured for estimating a moisture content of the clothes in the dryer appliance using the chamber temperature, the exhaust temperature, and the chamber humidity, adjusting at least one operating parameter of the dryer appliance in response to the estimated moisture content of the clothes.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
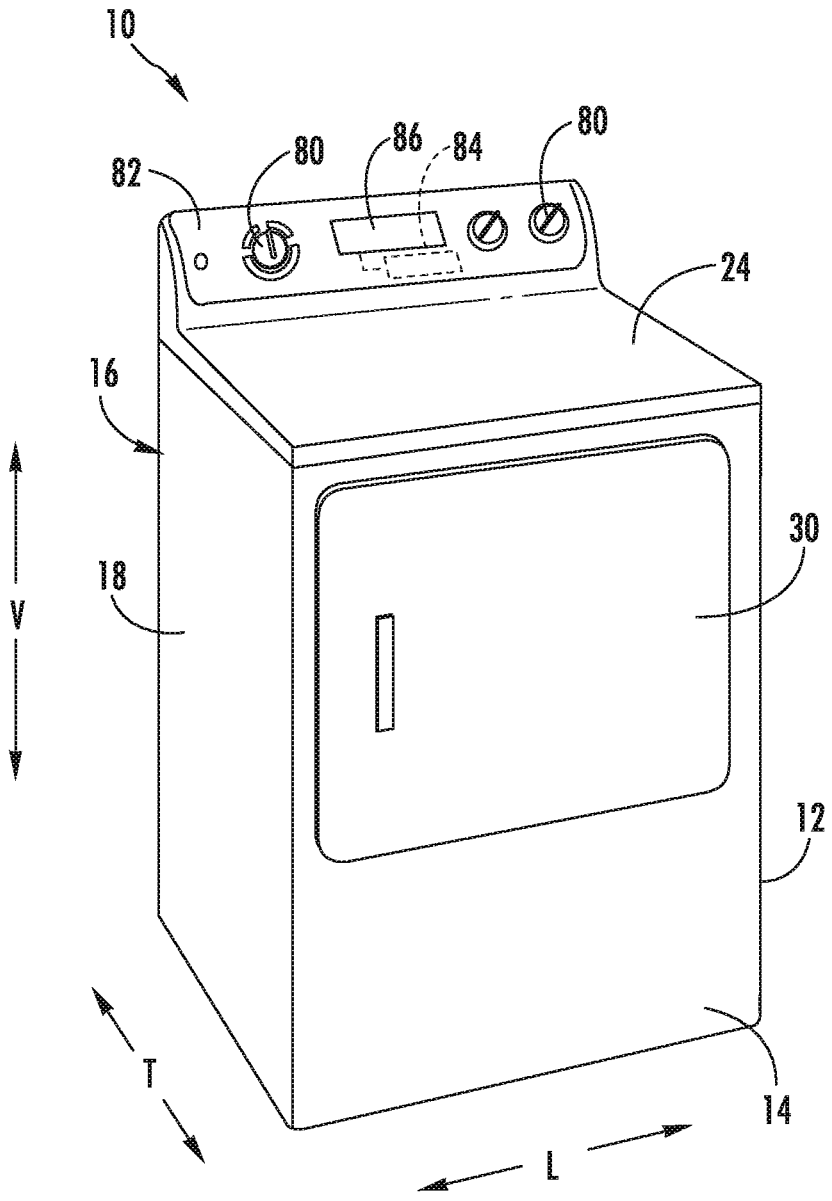
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
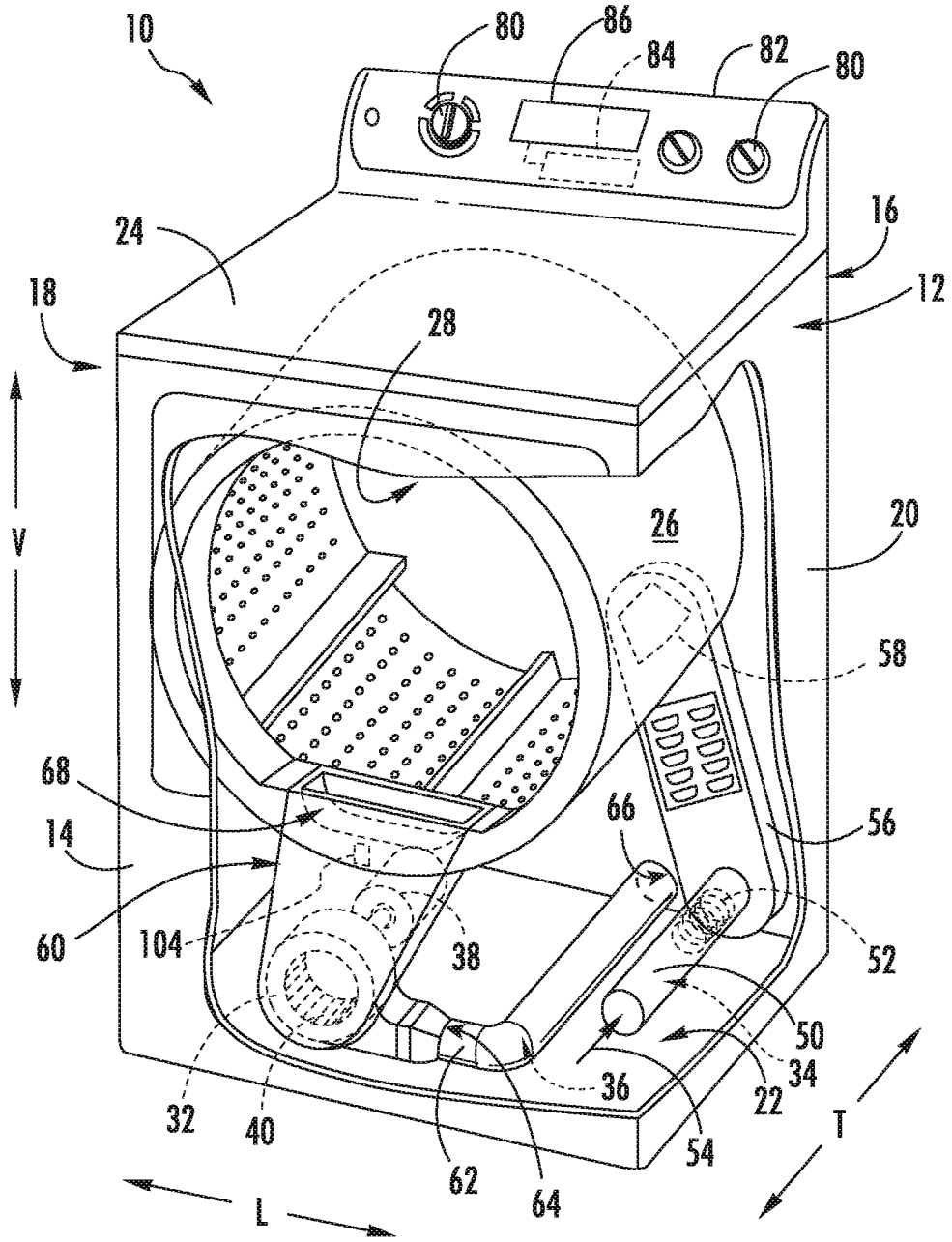
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a trap duct 60, air handler 32, and an exhaust conduit 62. Exhaust conduit 62 is in fluid communication with trap duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through trap duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, trap duct 60 may include a filter portion 68 which includes a screen filter or other suitable device for removing lint and other particulates as internal air is drawn out of chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet backsplash 82. Display 86 may be in communication with controller 84, and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance, such as described below. For example, dryer appliance 10 may include one or more temperature sensors which are generally operable to measure internal temperatures in dryer appliance 10 and/or one or more airflow sensors which are generally operable to detect the velocity of air (e.g., as an air flow rate in meters per second, or as a volumetric velocity in cubic meters per second) as it flows through the appliance 10. In some embodiments, controller 84 is configured to vary operation of heating assembly 50 based on one or more temperatures detected by the temperature sensors or air flow measurements from the airflow sensors.

Referring now generally to FIGS. 3 through 7, a system and method for detecting the moisture content of clothes within chamber 28 will be described according to an exemplary embodiment of the present subject matter. Although exemplary systems and methods of detecting the moisture content of clothes are described as being used in dryer appliance 10, it should be appreciated that aspects of the present subject matter may be used for detecting moisture content in any other suitable appliance. In this regard, the exemplary embodiment described herein is not intended to limit the scope of the present subject matter.

As used herein, "moisture content" is intended to refer to an estimated amount of water within clothes in chamber 28 of dryer appliance 10. In general, moisture content may represent the humidity within a volume of clothes, and may be referred to as the "remaining moisture content" (RMC) to refer to the amount of liquid remaining within clothes during a drying cycle. The term "final moisture content"(FMC) may be used herein to refer to a desired amount of moisture content or a moisture content threshold below which the clothes may be considered dry. For example, according to exemplary embodiments, the FMC may be less than 3% for dry clothes and less than 15% for moderately dry or slightly damp clothes.

Figure 3:
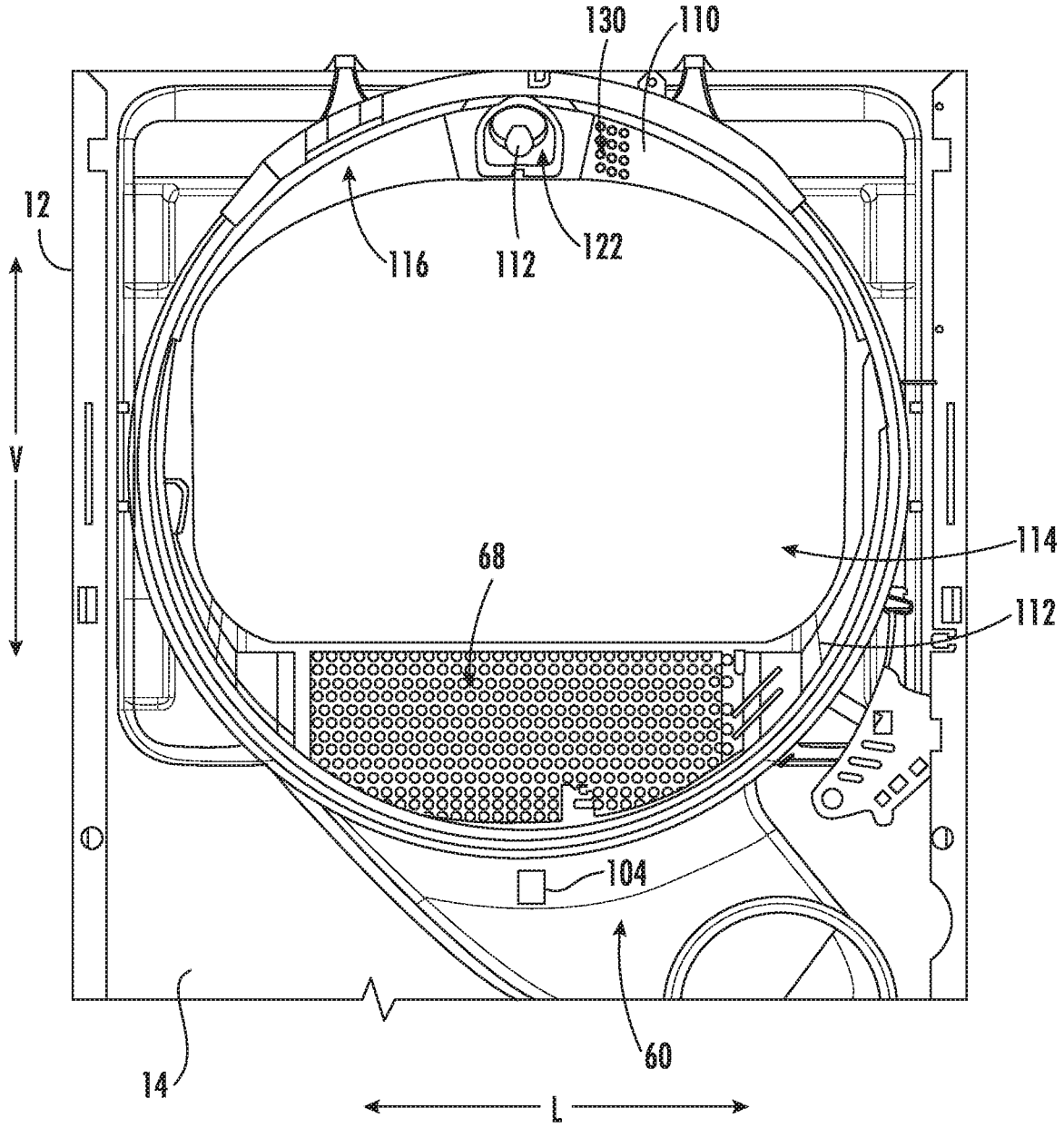
FIG. 3 provides a rear view of a top bearing of the exemplary dryer appliance of FIG. 1 according to an exemplary embodiment of the present subject matter.
Figure 4:
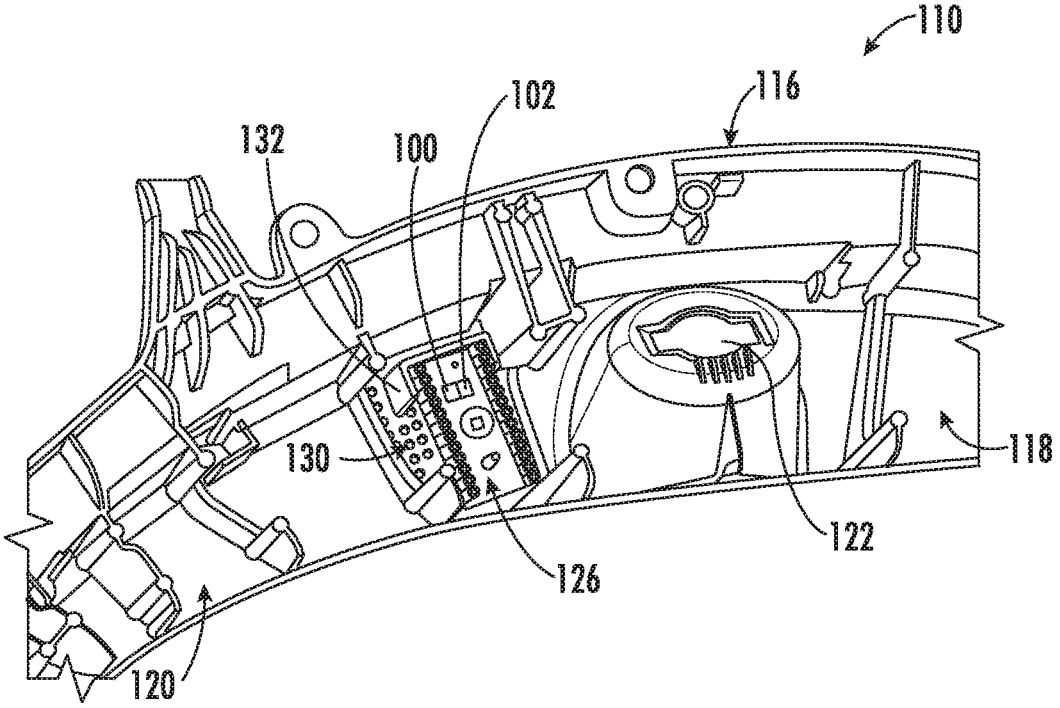
FIG. 4 provides a perspective view of an inner surface of the exemplary top bearing of FIG. 3 including a sensor chip according to an exemplary embodiment of the present subject matter.
Figure 5:
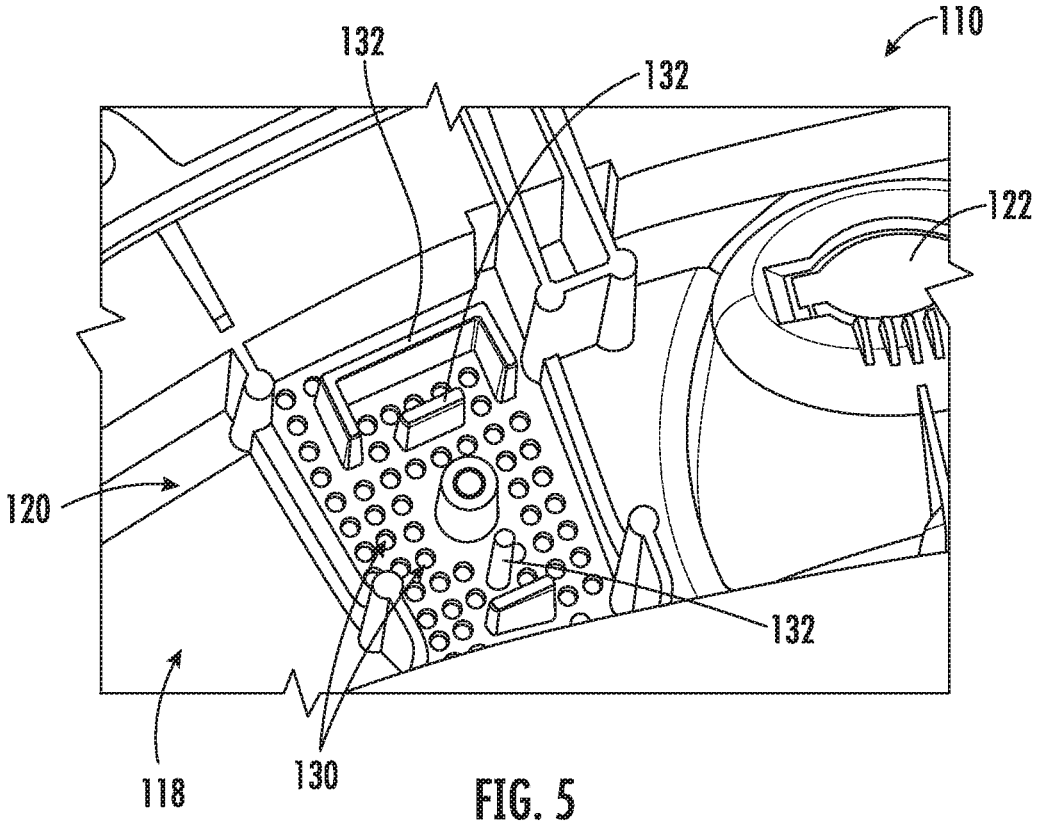
FIG. 5 provides a perspective view of an inner surface of the exemplary top bearing of FIG. 3 with the sensor chip removed to reveal mounting features defined by the top bearing according to an exemplary embodiment of the present subject matter.

Referring now generally to FIGS. 3 through 5, an exemplary system and method for obtaining operating parameters of dryer appliance 10 will be described according to an exemplary embodiment of the present subject matter. More specifically, as will be described in more detail below, aspects of the present subject matter are directed to determining the moisture content of clothes within chamber 28 using a temperature measurement and a humidity measurement within chamber 28. More specifically, dryer appliance 10 includes a chamber temperature sensor 100 which is generally configured for measuring a chamber temperature ($T_C$), a humidity sensor 102 which is generally configured for measuring a chamber humidity ($RH_C$), and an exhaust temperature sensor 104 (FIGS. 2 and 3) positioned within trap duct 60 for measuring an exhaust temperature ($T_{OUT}$) of dryer appliance 100. Although exhaust temperature sensor 104 is illustrated as being positioned within trap duct 60, it should be appreciated that it may be positioned in exhaust conduit 62 or any other suitable location within the exhaust stream according to alternative embodiments.

As described herein, "temperature sensor" may refer to any suitable type of temperature sensor. For example, the temperature sensors may be thermocouples, thermistors, or resistance temperature detectors. Similarly, "humidity sensor" may refer to any suitable type of humidity sensor, such as capacitive digital sensors, resistive sensors, and thermal conductivity humidity sensors. In addition, temperature sensors 100, 104 and humidity sensor 102 may be mounted at any suitable location and in any suitable manner for obtaining a desired temperature or humidity measurement, either directly or indirectly. Although exemplary positioning of certain sensors is described below, it should be appreciated that dryer appliance 10 may include any other suitable number, type, and position of temperature and/or humidity sensors according to alternative embodiments.

According to the illustrated embodiment, temperature sensor 100 and humidity sensor 102 are positioned within a top bearing 110 of dryer appliance 10. In this regard, top bearing 110 is generally positioned at a front of drum 26 and cabinet 12. In addition, top bearing 110 and a front bulkhead 112 generally define an opening 114 through which chamber 28 may be accessed. More specifically, top bearing 110 is positioned above front bulkhead 112 and defines a surface on which drum 26 may rotate. As illustrated, top bearing 110 may define an outer surface 116 and an inner surface 118. In this regard, outer surface 116 is exposed to or faces chamber 28, while inner surface 118 is mounted on front panel 14 and defines a cavity 120 which may house electronic components outside of chamber 28.

For example, as best shown in FIG. 3, top bearing 110 may define a bulb housing 122 for receiving a light bulb 124 four illuminating chamber 28 when desired. The electronics (not shown) for powering light bulb 124 may be housed behind the top bearing, e.g., within a cavity 120 and may be operably coupled with controller 84 which may regulate operation of light bulb 124.

In addition, according to the illustrated embodiment, temperature sensor 100 and humidity sensor 102 are mounted on a single chip 126 that is operably coupled to controller 84, e.g., for performing methods described herein. In addition, in order to permit chamber air to contact temperature sensor 100 and humidity sensor 102, top bearing 110 may define a plurality of holes 130 through which the chamber air may pass into cavity 120. As shown, top bearing 110 may further define mounting features 132 for locating and mounting chip 126 onto top bearing 110. For example, as illustrated, mounting features 132 include pin locators, supports, and mounting bosses, for properly aligning, supporting, and fastening chip 126, respectively.

Notably, as illustrated, temperature sensor 100 and humidity sensor 102 are positioned proximate top cover 24 of dryer appliance 10 and at a very top of chamber 28 along the vertical direction V. In this manner, temperature and humidity measurements may be obtained at a location outside of the primary flow of air through chamber 28, and away from trap duct 60, exhaust conduit 62, etc. In this regard, the flow of heated air passing through chamber 28 generally flows from a rear of drum 26 (e.g., via outlet 58), forward along the transverse direction T, and through the trap duct 60 which is located proximate a bottom of drum 26. Therefore, by positioning temperature sensor 100 and humidity sensor 102 at the top of chamber 28, the effects of the primary flow of air may be isolated, and an ambient temperature and humidity reading may be accurately obtained. In addition, the likelihood of clothes or liquid contacting these sensors is reduced. Furthermore, temperature sensor 100 and humidity sensor 102 are positioned behind the top bearing 110 to further reduce the likelihood of erroneous measurements and to obtain true ambient temperature and humidity readings.

Now that the construction and configuration of dryer appliance 10 according to an exemplary embodiment of the present subject matter has been presented, an exemplary method 200 for detecting the moisture content of clothes in a dryer appliance according to an exemplary embodiment of the present subject matter is provided. Method 200 can be used with dryer appliance 10, or any other suitable dryer appliance. In this regard, for example, controller 84 may be configured for implementing method 200. However, it should be appreciated that the exemplary method 200 is discussed herein only to describe exemplary aspects of the present subject matter, and is not intended to be limiting.

Figure 6:
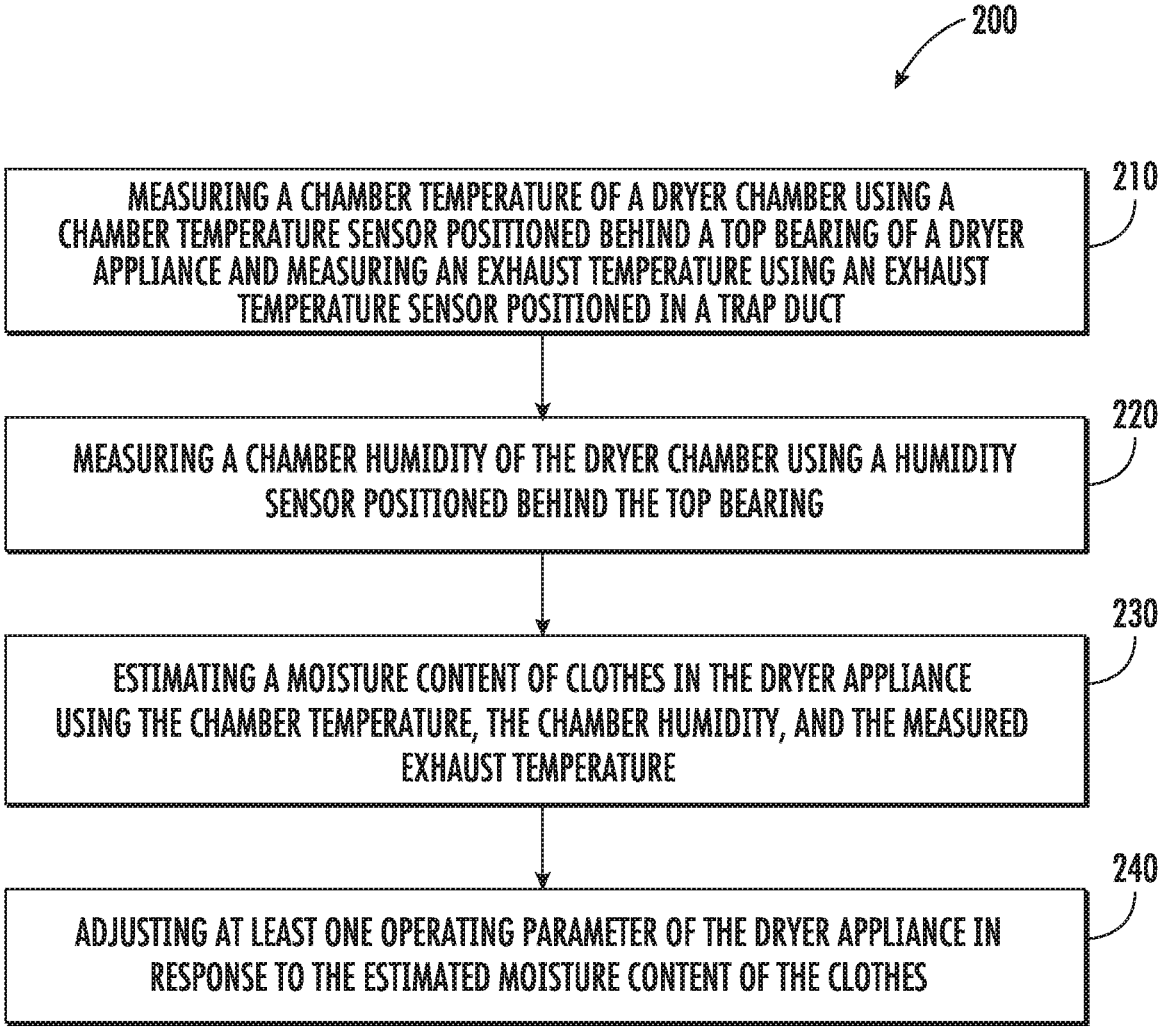
FIG. 6 is a method of detecting a moisture content of clothes in a dryer appliance in accordance with one embodiment of the present disclosure.

As shown in FIG. 6, method 200 includes, at step 210, measuring a chamber temperature ($T_C$) of a dryer chamber using a temperature sensor positioned behind a top bearing of a dryer appliance and an exhaust temperature ($T_{OUT}$) using an exhaust temperature sensor positioned in a trap duct. In addition, step 220 includes measuring a chamber humidity ($RH_C$) of the dryer chamber using a humidity sensor positioned behind the top bearing. For example, continuing the example from above, the chamber temperature ($T_C$), the exhaust temperature ($T_{OUT}$), and the chamber humidity ($RH_C$) may be measured using chamber temperature sensor 100, chamber humidity sensor 102, and exhaust temperature sensor 104, respectively.

Figure 7:
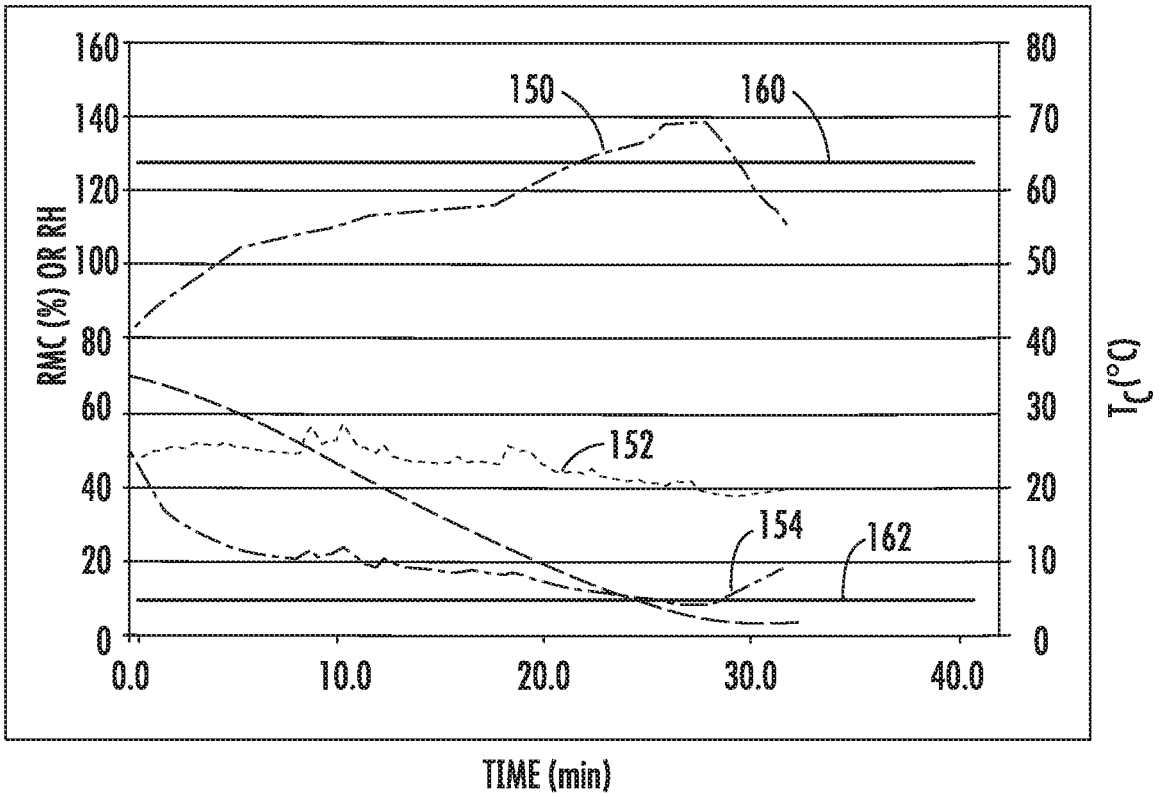
FIG. 7 provides a plot of the chamber temperature, humidity, and moisture content during a drying cycle according to an exemplary embodiment of the present subject matter.

To facilitate discussion herein, FIG. 7 is a plot including exemplary temperature and humidity measurements according to an exemplary embodiment. The values and operating cycles illustrated in this plot are only intended to help describe aspects of the present subject matter and are not intended to limit the scope in any manner. More specifically, the exhaust temperature ($T_{OUT}$), e.g. as measured at step 210, is identified by line 150. Similarly, the chamber humidity ($RH_C$), e.g. as measured at step 220, is identified by line 152. As described in more detail below, an outlet humidity ($RH_{OUT}$) is estimated using the methods below in order to provide an indication of the moisture content of the clothes in the dryer appliance 10.

Referring again to FIG. 6, method 200 further includes, at step 230, estimating the moisture content of the clothes in the dryer appliance using the chamber temperature ($T_C$, e.g., measured at step 210), the exhaust temperature ($T_{OUT}$, e.g., measured at step 210), and the chamber humidity ($RH_C$, e.g., measured at step 220). In this regard, for example, controller 84 may be programmed to estimate the moisture content (MC) according to the methods described herein. One exemplary method of estimating the moisture content (MC) is described below.

According to an exemplary embodiment, the vapor density in the drying chamber ($VD_C$) in the dryer appliance 10 can be estimated using the following equation:

$$VD_C = \frac{RH_C \cdot VD_{Sat}}{100}$$

In the above equation, $RH_C$ is the measured chamber humidity (e.g., by chamber humidity sensor 102) and $VD_{Sat}$ is a saturation vapor density. According to exemplary embodiments, the measured chamber humidity ($RH_C$) is determined using humidity sensor 102. The saturation vapor density ($VD_{Sat}$) may be determined empirically, may be obtained from a lookup table, may be formulated using an equation, or may be determined in any other suitable manner. For example, according to one embodiment, estimating the moisture content (MC) may comprise determining the saturation vapor density ($VD_{Sat}$) using a psychometric table, which generally correlates a temperature of air to the amount of water vapor that may be contained within a given volume of that air. For example, an exemplary psychometric table to determine a saturation vapor density ($VD_{Sat}$) as a function of the chamber temperature ($T_C$) in degrees Celsius is provided in Table 1 below:

TABLE 1

Psychometric Table for Saturation Vapor Density

| Temperature (° C.) | Water in saturation (kg)/Dry air (kg) |
|---|---|
| 0 | 3.8 |
| 5 | 5.4 |
| 10 | 7.6 |
| 15 | 9.6 |
| 20 | 15.8 |
| 25 | 22.0 |
| 30 | 27.3 |

Therefore, by using the measured chamber temperature ($T_C$) determined at step 210 (e.g., as measured by chamber temperature sensor 100), a psychometric table (e.g., Table 1) may be used to determine the saturation vapor density ($VD_{Sat}$) within the dryer chamber. According still another embodiment, a polynomial regression equation may be used to determine the saturation vapor density ($VD_{Sat}$). For example, the polynomial regression equation may be determined from the data in a psychometric table, such as Table 1, resulting in equation shown below:

$$VD_{Sat}(T_C) = -0.0003 \cdot T_C^3 + 0.0353 \cdot T_C^2 - 0.0152 \cdot T_C + 4.0905$$

Notably, using the saturation vapor density ($VD_{Sat}$) and the measured chamber humidity ($RH_C$), a vapor density in the chamber ($VD_C$) may be calculated using the equation above. Using the vapor density in the chamber ($VD_C$) as a proxy for the vapor density at the exhaust of the chamber, an estimated relative humidity of at the exhaust ($RH_{OUT}$) may by reworking the equation above as follows:

$$RH_{OUT} = 100 \cdot \frac{VD_C}{VD_{Sat_OUT}}$$

Notably, the saturation vapor density at the outlet ($VD_{Sat_OUT}$) may be calculated using a psychometric table (e.g., Table 1 above) or using the polynomial regression equation above as a function of the exhaust temperature ($T_{OUT}$). Thus an estimate of the relative humidity at the exhaust ($RH_{OUT}$) is calculated. This estimated relative humidity at the exhaust or the estimated outlet humidity ($RH_{OUT}$) is illustrated in FIG. 7 by line 154. Using the methods described herein, the relative humidity at the exhaust ($RH_{OUT}$) may be used as an indicator of the moisture content (MC) of the clothes with improved accuracy, consistency, and reliability. This moisture content (MC) may then be used to adjust the operation of dryer appliance 10 for improved performance. Exemplary methods of adjusting the operation of dryer appliance 10 in response to the estimated moisture content (MC) or other measured parameters are described below.

Referring again to FIG. 6, step 240 includes adjusting at least one operating parameter of the dryer appliance in response to the estimated moisture content of clothes. As used herein, an "operating parameter" of dryer appliance 10 is any cycle setting, operating time, component setting, spin speed, part configuration, or other operating characteristic that may affect the performance of dryer appliance 10. Thus, references to operating parameter adjustments or "adjusting at least one operating parameter" are intended to refer to control actions intended to improve system performance in response to chamber temperature measurements, chamber humidity measurements, estimated moisture content, etc.

According to exemplary embodiments of the present subject matter, dryer appliance 10 may be turned off or may enter a cool down cycle when the estimated moisture content drops below a predetermined level. For example, as used herein, a "cool down" cycle may be used to refer to a final stage of the total drying cycle where a heating element (such as heater 52) is shut off but an air handler (such as air handler 32) continues to circulate air through chamber 28 to cool drum 26 and articles of clothing positioned therein to a suitable temperature threshold, e.g., such that it is safe for a user to remove the clothes without being burned.

According still another embodiment, the at least one operating parameter is adjusted when the measured exhaust temperature 150 exceeds a temperature threshold 160 and when the estimated moisture content or outlet humidity 154 drops below a humidity threshold 162. This condition is illustrated for example in FIG. 7. According to exemplary embodiments of the present subject matter, the temperature threshold 160 and the humidity threshold 162 are determined as a function of at least one of a load size, a load type, and a dryer air flow rate. However, it should be appreciated that these thresholds may be determined in any other suitable manner for a given dryer appliance.

For certain load types or sizes, it may be desirable to initiate a timed dry segment after the exhaust temperature 150 has exceeded the temperature threshold 160 and the estimated outlet humidity 154 has dropped below the humidity threshold 162. Therefore, according to exemplary embodiments, the adjusting of at least one operating parameter may include initiating a timed dry segment where a heating element remains on and the air handler continues to circulate air through the chamber for a predetermined amount of time, e.g., the amount of time to make the clothes "extra dry" or below a very low moisture content. The dryer appliance may then be shut off or an additional cool down cycle may be initiated.

Notably, the parameters measured and calculated herein may be used to improve the performance of dryer appliance 10 in other manners as well. For example, the chamber temperature, the chamber humidity, and/or the estimated moisture content may be used to detect operating issues with dryer appliance 10 or to otherwise identify ways to improve dryer performance. For example, according to an exemplary embodiment, an operating issue may be detected based on the measured chamber humidity. In this regard, for example, if the measured chamber humidity remains substantially constant for a predetermined amount of time, this may indicate the presence of a clogged filter, an empty drum, a flow restriction to the humidity sensor 102 (e.g., such as clogged holes 130), or an improper load size. It should be appreciated that as used herein, terms of approximation, such as "approximately," "substantially," or "about," refer to being within a ten percent margin of error. Thus, if the measured chamber humidity vacillates about a specific humidity even though the measured chamber temperature increases, this may indicate a faulty sensor reading or other issue. In such a situation, the user may be provided with an indication to take corrective action or the appliance may automatically initiate such a corrective action.

FIG. 6 depicts an exemplary control method having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using dryer appliance 10 as an example, it should be appreciated that these methods may be applied to the operation of any suitable dryer type and configuration.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of detecting a moisture content of clothes in a dryer appliance, the dryer appliance comprising a drum defining a chamber, a chamber temperature sensor being positioned proximate a top of the drum, an exhaust temperature sensor, and a humidity sensor being positioned proximate a top of the drum, the method comprising:

measuring a chamber temperature using the chamber temperature sensor and an exhaust temperature using the exhaust temperature sensor;

measuring a chamber humidity using the humidity sensor;

estimating the moisture content of the clothes in the dryer appliance using the chamber temperature, the exhaust temperature sensor, and the chamber humidity; and adjusting at least one operating parameter of the dryer appliance in response to the estimated moisture content of the clothes, wherein estimating the moisture content comprises using the following polynomial regression equation:

$$VD_{Sat}(T_C)=-0.0003\cdot T_C^3+0.0353\cdot T_C^2-0.0152\cdot T_C+4.0905$$

where: $T_C$ is the measured chamber temperature (in ° C.); and $VD_{Sat}$ is a saturation vapor density.

2. The method of claim 1, wherein estimating the moisture content comprises using a psychometric table to determine the saturation vapor density.

3. The method of claim 2, wherein using the psychometric table comprises formulating the polynomial regression equation for calculating the saturation vapor density as a function of the chamber temperature.

4. The method of claim 1, wherein estimating the moisture content comprises using the following equation to determine the chamber vapor density:

$$VD_C = \frac{RH_C \cdot VD_{Sat}}{100}$$

where: $RH_C$ is the measured chamber humidity;

$VD_{Sat}$ is the saturation vapor density; and $VD_C$ is a vapor density in the chamber.

5. The method of claim 1, wherein the at least one operating parameter is adjusted when the measured exhaust temperature exceeds a temperature threshold and an estimated outlet humidity drops below a humidity threshold, wherein the estimated outlet humidity is calculated using the following equation:

$$RH_{OUT} = 100 \cdot \frac{VD_C}{VD_{Sat_OUT}}$$

where: $RH_{OUT}$ is the estimated outlet humidity;

$VD_{Sat_OUT}$ is the saturation vapor density at the exhaust; and $VD_C$ is a vapor density in the chamber.

6. The method of claim 5, wherein the temperature threshold and the humidity threshold are determined as a function of at least one of a load size, a load type, and a dryer air flow rate.

7. The method of claim 1, wherein adjusting at least one operating parameter of the dryer appliance comprises:

initiating a cool down cycle where a heating element is turned off and an air handler continues to circulate air through the chamber for a predetermined cooling time.

8. The method of claim 7, wherein the predetermined cooling time is empirically determined as the amount of time necessary to drop the chamber temperature below a temperature threshold.

9. The method of claim 1, wherein adjusting at least one operating parameter of the dryer appliance comprises:

initiating a timed dry segment where a heating element remains on and an air handler continues to circulate air through the chamber for a predetermined fixed time.

10. The method of claim 1, comprising:

detecting an operating issue based on the measured humidity.

11. The method of claim 10, wherein detecting the operating issue comprises:

determining that the measured humidity has remained substantially constant for a predetermined time.

12. The method of claim 10, wherein the operating issue is a clogged filter, an empty drum, a flow restriction to the humidity sensor, or an improper load size.

13. The method of claim 1, wherein the chamber temperature sensor and the humidity sensor are positioned within a top bearing of the dryer appliance.

14. The method of claim 13, wherein the chamber temperature sensor and the humidity sensor are positioned on an inner surface of the top bearing outside the chamber, and wherein the top bearing defines a plurality of holes to permit chamber air to contact the chamber temperature sensor and the humidity sensor.

15. A dryer appliance comprising:

a cabinet;

a drum rotatably mounted within the cabinet, the drum defining a chamber for receipt of clothes for drying;

a top bearing positioned proximate a front of the drum;

a chamber temperature sensor positioned within the top bearing for measuring the chamber temperature;

an exhaust temperature sensor positioned within a trap duct for measuring an exhaust temperature;

a humidity sensor positioned within the top bearing for measuring the chamber humidity; and a controller operably coupled to the chamber temperature sensor, the exhaust temperature sensor, and the humidity sensor, the controller configured for:

obtaining the chamber temperature using the chamber temperature sensor;

obtaining the exhaust temperature using the exhaust temperature sensor;

obtaining the chamber humidity using the humidity sensor;

estimating a moisture content of the clothes in the dryer appliance using the chamber temperature, the exhaust temperature, and the chamber humidity; and adjusting at least one operating parameter of the dryer appliance in response to the estimated moisture content of the clothes, wherein estimating the moisture content comprises using the following equation to determine a chamber vapor density:

$$VD_C = \frac{RH_C \cdot VD_{Sat}}{100}$$

where: $RH_C$ is the measured chamber humidity;

$VD_{Sat}$ is a saturation vapor density; and $VD_C$ is a vapor density in the chamber.

16. The dryer appliance of claim 15, wherein the chamber temperature sensor and the humidity sensor are positioned on an inner surface of the top bearing outside the chamber, and wherein the top bearing defines a plurality of holes to permit chamber air to contact the chamber temperature sensor and the humidity sensor.

17. The dryer appliance of claim 15, wherein estimating the moisture content comprises using a psychometric table to formulate a polynomial regression equation for calculating the saturation vapor density as follows:

$$VD_{Sat}(T_C) = -0.0003 \cdot T_C^3 + 0.0353 \cdot T_C^2 - 0.0152 \cdot T_C + 4.0905$$

where: $T_C$ is the measured chamber temperature (in ° C.); and $VD_{Sat}$ is the saturation vapor density.

18. The dryer appliance of claim 15, wherein the at least one operating parameter is adjusted when the measured exhaust temperature exceeds a temperature threshold and the estimated outlet humidity drops below a humidity threshold, and wherein the temperature threshold and the humidity threshold are determined as a function of at least one of a load size, a load type, and a dryer air flow rate.

19. A dryer appliance comprising:

a cabinet;

a drum rotatably mounted within the cabinet, the drum defining a chamber for receipt of clothes for drying;

a top bearing positioned proximate a front of the drum;

a chamber temperature sensor positioned within the top bearing for measuring the chamber temperature;

an exhaust temperature sensor positioned within a trap duct for measuring an exhaust temperature;

a humidity sensor positioned within the top bearing for measuring the chamber humidity; and a controller operably coupled to the chamber temperature sensor, the exhaust temperature sensor, and the humidity sensor, the controller configured for:

obtaining the chamber temperature using the chamber temperature sensor;

obtaining the exhaust temperature using the exhaust temperature sensor;

obtaining the chamber humidity using the humidity sensor;

estimating a moisture content of the clothes in the dryer appliance using the chamber temperature, the exhaust temperature, and the chamber humidity; and adjusting at least one operating parameter of the dryer appliance in response to the estimated moisture content of the clothes, wherein the at least one operating parameter is adjusted when the measured exhaust temperature exceeds a temperature threshold and an estimated outlet humidity drops below a humidity threshold, wherein the estimated outlet humidity is calculated using the following equation:

$$RH_{OUT} = 100 \cdot \frac{VD_C}{VD_{Sat_OUT}}$$

where: $RH_{OUT}$ is the estimated outlet humidity;

$VD_{Sat_OUT}$ is a saturation vapor density at the exhaust; and $VD_C$ is a vapor density in the chamber.

20. The dryer appliance of claim 19, wherein the chamber temperature sensor and the humidity sensor are positioned on an inner surface of the top bearing outside the chamber, and wherein the top bearing defines a plurality of holes to permit chamber air to contact the chamber temperature sensor and the humidity sensor.

* * * * *